United States Patent [19]

Lanmon, II

[11] 4,307,783

[45] Dec. 29, 1981

[54] METHOD AND APPARATUS FOR CONDUCTING WIRELINE OPERATIONS DURING BLOWOUT CONDITIONS IN OIL AND GAS WELLS

[75] Inventor: C. P. Lanmon, II, Friendswood, Tex.

[73] Assignee: Schlumberger Technology Corporation, Houston, Tex.

[21] Appl. No.: 115,430

[22] Filed: Jan. 25, 1980

[51] Int. Cl.[3] ..... E21B 33/03; E21B 33/06; E21B 33/072

[52] U.S. Cl. ..... 166/379; 166/77; 166/82; 166/84; 166/385

[58] Field of Search ..... 166/77, 82, 84, 85, 166/88, 315, 90, 379, 385; 251/1 B

[56] References Cited

U.S. PATENT DOCUMENTS

| | | | |
|---|---|---|---|
| 1,762,211 | 6/1930 | Bradford . | |
| 2,212,040 | 8/1940 | Parrish . | |
| 2,748,870 | 6/1956 | Basham et al. | 166/77 |
| 2,839,263 | 6/1958 | Kisling . | |
| 2,943,682 | 7/1960 | Ingram, Jr. et al. | 166/77 |
| 3,416,767 | 12/1968 | Blagg . | |
| 3,492,027 | 1/1970 | Herring . | |
| 3,500,907 | 3/1970 | Gentry | 166/70 |
| 3,583,480 | 6/1971 | Regan | 166/82 X |
| 3,831,676 | 8/1974 | Brown et al. | 166/82 |
| 3,887,158 | 6/1975 | Polk | 251/1 B |

FOREIGN PATENT DOCUMENTS 2146099 8/1971 France .

OTHER PUBLICATIONS

Regan Forge & Engineering Company, Advertising Brochure Entitled "Regan Conical Wire Line Blowout Preventer".

*Primary Examiner*—Stephen J. Novosad

[57] ABSTRACT

A method and apparatus for conducting wireline operations in oil and gas wells under blowout conditions is disclosed, wherein a releasable annular wireline blowout preventer is provided, whereby wireline operations may be conducted under normal operating conditions by only using a short riser and a releasable annular wireline blowout preventer. Under blowout conditions, a second riser may be attached to the releasable annular wireline blowout preventer to quickly enable a wireline suspended tool to be safely removed from the well, along with the releasable wireline seal assembly means of the blowout preventer.

12 Claims, 6 Drawing Figures

METHOD AND APPARATUS FOR CONDUCTING WIRELINE OPERATIONS DURING BLOWOUT CONDITIONS IN OIL AND GAS WELLS

BACKGROUND OF THE INVENTION

I. Field of the Invention

The invention relates to a method and apparatus for conducting wireline operations in oil and gas wells under blowout conditions, and includes a releasable annular wireline blowout preventer.

II. Description of the Prior Art

It is frequently necessary to periodically introduce various cable, or wireline, suspended well tools or instruments into open hole or producing oil or gas wells. Where a well is producing or is an open hole well and contains well fluids such as drilling mud at high pressures, the upper end of the well casing is closed by suitable valving apparatus and special well-servicing equipment must be provided to safely introduce and remove such wireline tools or instruments.

In performing wireline operations for wells under pressure, it is required that the well pressure be controlled during such operations. It must be possible to: lower the wireline suspended tool into the well; perform the conventional wireline operations, such as well logging or perforating operations; and recover the wireline suspended tool, while the well remains sealed. Since all wireline operations involve a moving wireline, or cable, a seal must be provided to prevent well fluid or gas from escaping from the well, while simultaneously allowing free movement of the cable. Furthermore, although an uncased well is normally held under pressure control by drilling mud present in the well, occasionally the pressure forces become unbalanced and the well blows out. Because of such potential emergency situations caused by excessive pressure buildup, or blowout conditions within the well, it is necessary to provide the well with pressure control equipment to quickly allow the well to be sealed when such blowout conditions are encountered and thereafter safely recover the wireline suspended tool.

Accordingly, conventional oil and gas wells which include a main cut-off valve on the wellhead have been provided with a blowout preventer temporarily connected to the cut-off valve on the wellhead. To such blowout preventer, a riser comprising one or more lengths of pressure-control pipe is installed. The riser is sealed at its upper end by a stuffing box, or line wiper, to provide a pressure seal around the wireline at the point where the wireline exits from the riser.

In this manner, when the main wellhead cut-off valve is closed, the wireline suspended tool can be safely inserted into the riser. The wireline is then passed through the stuffing box which is then sealed about the wireline. After the main cut-off valve is opened, the wireline suspended tool is lowered through the open blowout preventer and on into the well. Representative examples of such devices and methods of operation may be found in U.S. Pat. Nos. 3,416,767, issued to L. Blagg and 3,887,158, issued to J. Polk.

In each of the foregoing patents, pressure control at the wellhead during the performance of wireline operations is provided by: a blowout preventer, or wireline valve, provided above the main cut-off valve; a long length of riser attached to the blowout preventer; and a stuffing box provided at the upper end of the riser.

Although such devices and methods of operation provide a means of removing wireline tools from an oil well under blowout conditions, without compromising established safety practices, such devices and method of operation require a great amount of equipment. This equipment must always be installed at the wellhead prior to the time when wireline operations are commenced in order to assure that the well may be controlled during emergency blowout conditions. Most of the time, the installation of such equipment is unnecessary especially in open-hole wells where most wells remain under control and blowout conditions are not encountered.

In particular, before conducting wireline operations, a great length of pressure-control pipe must always be installed, the length of the riser being dependent upon the length of the wireline suspended tools which must be accommodated within the long riser. Such long riser equipment is large, heavy, and requires considerable time to install, operate, and remove from the well after completion of wireline operations. Furthermore, the ram-type blowout preventers utilized beneath the long riser cannot be used to provide a seal about a moving wireline; however, they can be used to provide a seal about a wireline under static conditions. Consequently, the additional wireline stuffing box must be provided at the end of the riser to seal about moving wireline cables. Moreover, such ram-type blowout preventers, which are capable of allowing the through passage of wireline suspended tools, such as logging tools, are large, heavy, and bulky—thus presenting equipment handling problems at the wellhead.

Accordingly, prior to the development of the present method and apparatus, there has been no method or apparatus for conducting wireline operations in oil and gas wells under blowout conditions which: is efficient to install, operate, and remove; requires a minimum amount of equipment to be installed prior to performing wireline operations under normal conditions thereby greatly facilitating wireline operations on the large majority of wells for which blowout conditions are not encountered; provides a seal on a moving wireline; is economical; is safe in its operation; and does not require large, heavy, and bulky ram-type blowout preventers. Therefore, the invention provides a long sought efficient, safe, and less costly method and apparatus for conducting wireline operations in oil and gas wells, particularly uncased wells which may be subject to blowout, or other emergency, conditions.

SUMMARY OF THE INVENTION

In accordance with the invention, the foregoing benefits have been achieved through the present method and apparatus for conducting wireline operations in oil and gas wells under blowout conditions. The apparatus for conducting such wireline operations is a releasable annular wireline blowout preventer for use with oil and gas wells during wireline operations. It includes: an annular body having upper and lower ends, and an inner diameter capable of allowing the through passage of a wireline suspended tool; first means for attaching the annular body to a first riser, or directly to the well head cut-off valve, said first attachment means associated with the lower end of the annular body; second means for attaching the annular body to a second riser, said second attachment means associated with the upper end of the annular body; a wireline seal assembly means for preventing well fluid leakage about the wireline;

said annular body having selective engaging means for securing the seal assembly means within the annular body during normal wireline operations; and means for releasing said selective engaging means to allow the removal of the seal assembly means upwardly through the annular body, whereby during wireline operations under blowout conditions the seal assembly means and wireline suspended tool may be both removed through the annular body and into the second riser.

A feature of the present apparatus is the annular body being provided with means for equalizing pressure differences between the first and second risers. Further features of the apparatus of the present invention include means for locking the annular body to the first riser, and the wireline seal assembly means may include a hydraulically actuated resilient member which is compressed along and about the wireline upon actuation.

Additional features of the apparatus of the present invention are that the lower portion of the wireline seal assembly means includes a guide receptacle for the wireline suspended tool, and the selective engaging means may include at least two bolts, threaded in the annular body which, upon being rotated, contact the wireline seal assembly means.

The method of the present invention for conducting wireline operations in oil and gas wells and for removal of wireline suspended tools during blowout conditions in the well is used with a well provided with some type of main cut-off valve. The method comprises the steps of: fixedly securing an annular body to the top of a first riser associated with the cut-off valve, or directly to the cut-off valve, said body having an inner diameter capable of allowing the through passage of a wireline suspended tool; opening the cut-off valve; lowering a wireline suspended tool through said annular body, first riser, and cut-off valve, said wireline suspended tool having a wireline seal assembly means disposed about the wireline; securing the wireline seal assembly means within the annular body; and readying the second riser for attachment to the annular body in the event of possible blowout conditions. In the event of blowout conditions the method further comprises the steps of lowering the wireline suspended tool into the well; sealing the wireline seal assembly means about the wireline upon encountering blowout conditions in the well; passing a portion of the wireline which is disposed outside the well and wireline seal assembly means through a second riser having a stuffing box disposed in the upper end of the second riser; attaching the lower end of the second riser to the top of the annular body and sealing the stuffing box about the wireline; equalizing the pressure between the first and second risers; releasing the wireline seal assembly means from the annular body; raising the wireline suspended tool and wireline seal assembly means into the second riser and past the cut-off valve; and closing the cut-off valve to seal the well.

A feature of the foregoing method of the present invention includes the step of cutting the wireline prior to passing the wireline through the second riser.

Additional features of the foregoing method include the steps of releasing the pressure within the second riser after the cut-off valve is closed to seal the well, and dismantling the second riser, annular body, wireline suspended tool, and wireline seal assembly means from one another.

A further feature of the foregoing method of the present invention includes the step of raising the wireline suspended tool to a position adjacent the cut-off valve after blowout conditions are encountered in the well.

Another feature of the method of the present invention includes the step of attaching a second riser to the top of the annular body, whereby the length of the first and second riser is sufficient to enclose the wireline suspended tool.

The method and apparatus of the present invention for conducting wireline operations in oil and gas wells under blowout conditions, when compared with previously proposed prior art methods and apparatus have the advantages of: safety, ease of installation, operation, and removal; being less costly to manufacture and use; requiring only a minimum amount of equipment to be initially installed on the wellhead, thereby greatly facilitating wireline operations for the large majority of wells for which blowout conditions are not encountered; not requiring the use of a large, heavy and bulky ram-type blowout preventer; and can be used to provide a seal against leakage of well fluid from about a moving wireline.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
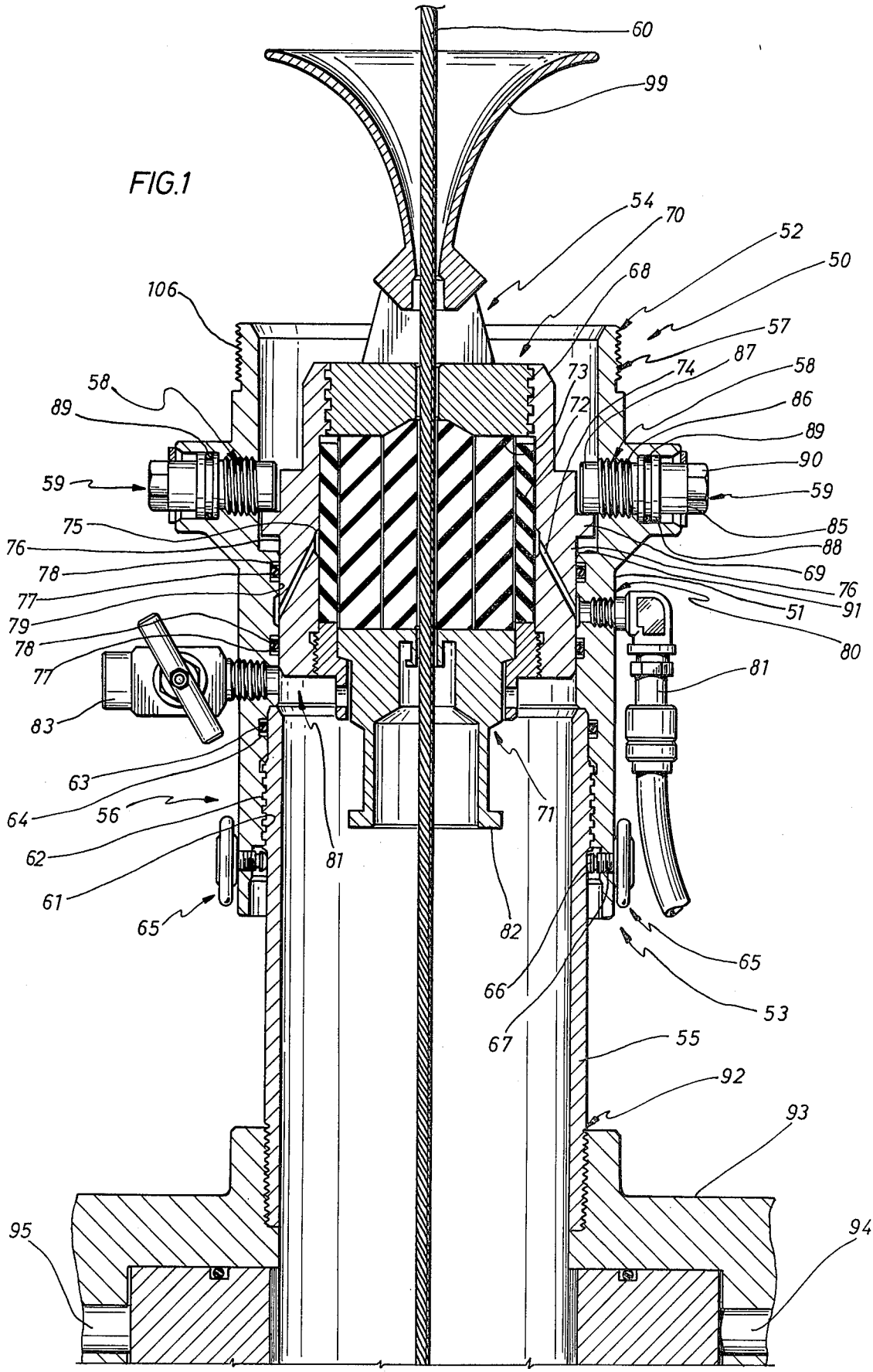
FIG. 1 is an enlarged cross-sectional view of the releasable annular wireline blowout preventer of the present invention, wherein the wireline seal assembly means is secured within the annular body.

In FIG. 1, an enlarged cross-sectional view is shown of the new and improved releasable annular wireline blowout preventer 50 of the invention. The releasable annular wireline blowout preventer 50 includes: an annular body 51 having upper and lower ends 52 and 53; a wireline seal assembly means 54; a first means for attaching the annular body 51 to a first riser, or length of pressure control pipe 55, said first means for attaching shown generally at 56 and is associated with the lower end 53 of the annular body 51. The annular body 51 may alternatively be attached directly, or via an integral annular extension, to the wellhead cut-off valve 93. The releasable annular wireline blowout preventer 50 also has associated with the upper end 52 of annular body 51, a second means for attaching the annular body 51 to a second riser, to be hereinafter described. The second attachment means is generally indicated at 57 and is associated with the upper end 52 of annular body 51.

Still referring to FIG. 1, it is seen that annular body 51 has selective engaging means 58 for securing the wireline seal assembly means 54 within annular body 51. The releasable annular wireline blowout preventer 50 is further provided with a means for releasing 59 the selective engaging means 58 from wireline seal assembly means 54. A conventional wireline 60, or flexible cable, passes through wireline seal assembly means 54. Attached to wireline 60 is a conventional wireline tool, as will be hereinafter described.

The releasable annular wireline blowout preventer 50 of the present invention will now be described in greater detail, while still referring to FIG. 1. Preferably, the first attachment means 56 for securing annular body 51 to the first riser 55 is internal threads 61 disposed on the interior of annular body 51 at its lower end 53. Threads 61 engage with the external threads 62 formed on the top outer surface of first riser 55. Annular body 51 could also be threadedly received within first riser 55 via external threads on annular body 51 which mate with internal threads formed at the top inner surface of first riser 55. Likewise, annular body 51 could be attached to first riser 55 via a flange connection, including an O-ring, or other suitable sealing means, or by any other suitable type of connection which would provide a fluid tight connection between first riser 55 and annular body 51. In this regard, annular body 51 is provided with an O-ring 63 for providing a fluid tight seal between the top of first riser 55 and annular body 51. Preferably, O-ring 63 is positioned in an annular groove 64 formed in the interior surface of annular body 51.

The releasable annular wireline blowout preventer 50 may also be provided with a means for locking the annular body 51 to the first riser 55, such locking means being generally shown at 65. Locking means 65 may preferably comprise one or more threaded bolts 66 which may be threaded through annular body 51 into engagement with the lower portion of external threads 62 of riser 55 as shown at 67.

Wireline seal assembly means 54 is seen in FIG. 1 to include a generally annular shaped body member 68 which includes an outwardly extending annular rib 69 which will be hereinafter described. The upper end of the annular body member 68 of wireline seal assembly means 54 is suitably closed at 70 as is the lower end of annular body member 68 closed at 71. Disposed within the interior of annular body member 68 of wireline seal assembly means 54 is an annular resilient bladder member 72, and another annular resilient member 73 is concentrically disposed about wireline 60, and is positioned between wireline 60 and bladder member 72. Annular resilient members 72 and 73 may be made of any suitable material having the requisite elastic capabilities to be deformed under pressure and assume its former shape after such pressure is released. Annular resilient member 73 must also have the ability to withstand exposure to well fluids which may be on the surface of wireline 60. Examples of such a material would be rubber, or other synthetic elastormeric materials having the foregoing qualities.

Annular body member 68 of wireline seal assembly means 54 also includes a hydraulic fluid passageway 74. Passageway 74 is preferably disposed between an annular groove 75, formed in the interior surface of body member 68, and the outer surface 76 of annular body member 68 of wireline seal assembly means 54.

Still referring to FIG. 1, it is seen that the interior surface of annular body 51 may be provided with a plurality of grooves 77 which contain O-rings 78 for providing a fluid tight seal between the outer surface 76 of annular body member 68 of wireline seal assembly means 54 and the interior surface 79 of annular body 51. Annular body 51 is also provided with a suitable connection shown generally at 80 for allowing a hydraulic hose 81 to be attached in fluid transmitting relationship to passageway 74 and annular groove 75 in body member 68 of wireline seal assembly means 54, as will be hereinafter described in more detail. The lower portion 71 of wireline seal assembly means 54 may also be provided with a guide receptacle 82 for the wireline tool suspended from wireline 60, as will also be hereinafter described.

As shown in FIG. 1, annular body 51 is provided with a suitable valve 83 which is disposed in fluid transmitting relationship with the interior of riser 55, as shown generally at 84, when annular body 51 is attached to riser 55. The function of valve 83 will be hereinafter described.

Selective engaging means 58 is generally shown to be one or more bolts 85, (preferably two) each having a threaded portion 86 received within annular body 51 and a generally smooth end portion 87 which contacts and rests upon the annular rib 69 formed on the outer surface of annular body member 68 of wireline seal assembly means 54. Upon inward movement caused by rotation of bolts 85, wireline seal assembly means 54 is secured within annular body 51. Selective engaging means 58 may also include an annular flange 88 disposed toward the middle of bolts 85, whereby O-rings 89 may be mounted about the portion of bolts 85 located between threads 86 and flange 88. Accordingly, upon rotation of bolts 85 as their end portions 87 contact the wireline seal assembly means 54, the O-rings 89 are compressed between the flanges 88 and the annular member 51, in order to provide a fluid tight seal between bolts 85 and annular member 51.

Figure 6:
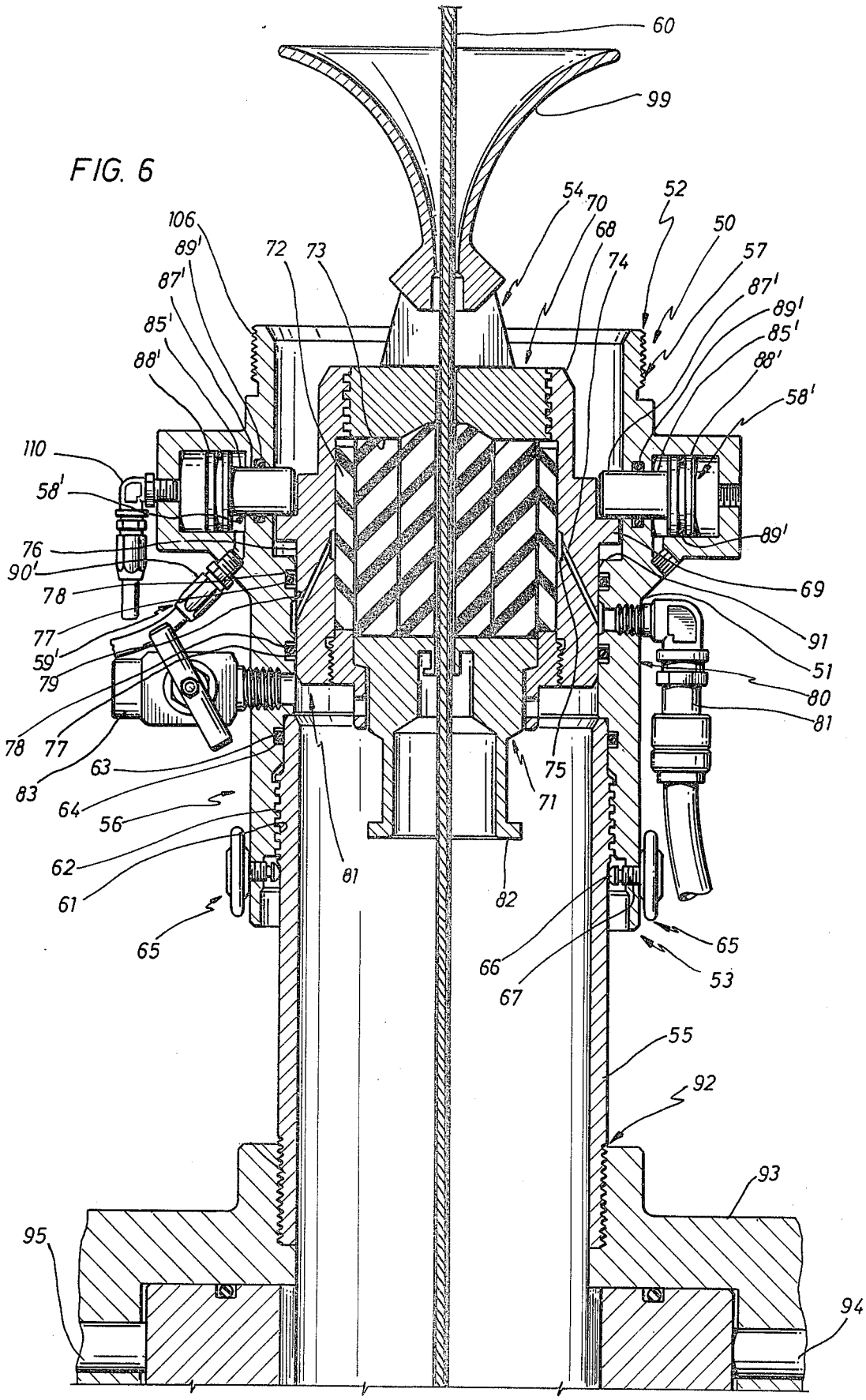

The outwardly extending head portions 90 of bolts 85 provide a means for releasing selective engaging means 58 and its smooth end portion 87 from the annular rib 69 of wireline seal assembly means 54. The releasing means 59, or bolt heads 90, may be rotated by means of a suitable wrench, as is readily apparent. Of course, other structures 58' and 59', as shown in FIG. 6, could be used for selective engaging means 58 and its releasing means 59, such as by substitution of at least one or more (preferably two or more) hydraulically operated piston members 85' (FIG. 6) which would have end portions 87' similar to end portions 87 of bolts 85 shown in FIG. 1. Upon hydraulic actuation of such piston members 85' via the fluid in hoses 110 (only one of which is shown for clarity in FIG. 6), their end portions 87' would engage annular body member 68 of wireline seal assembly means 54 above the annular rib 69 of body member 68. The releasing means 59' in FIG. 6 is provided by hydraulic actuation of piston members 85' via the fluid in hoses 90' (only one of which is shown in FIG. 6 for clarity). Piston members 85' are provided with suitable O-rings 89' to effect sealing as is well known in the art, and piston members 85' also include flanges 88' as previously described with reference to flange 88 of FIG. 1. It should be noted that both selective engaging means 58 and 58' cooperate with body member 68 of wireline seal assembly means 54 to preclude upward movement of the wireline seal assembly means 54 within annular body 51. Wireline seal assembly means 54 is precluded from downward movement within annular body 51 by the engagement of annular rib 69 with an interior ledge, or rib, 91 formed in annular body 51, as seen in FIG. 1.

Figure 2:
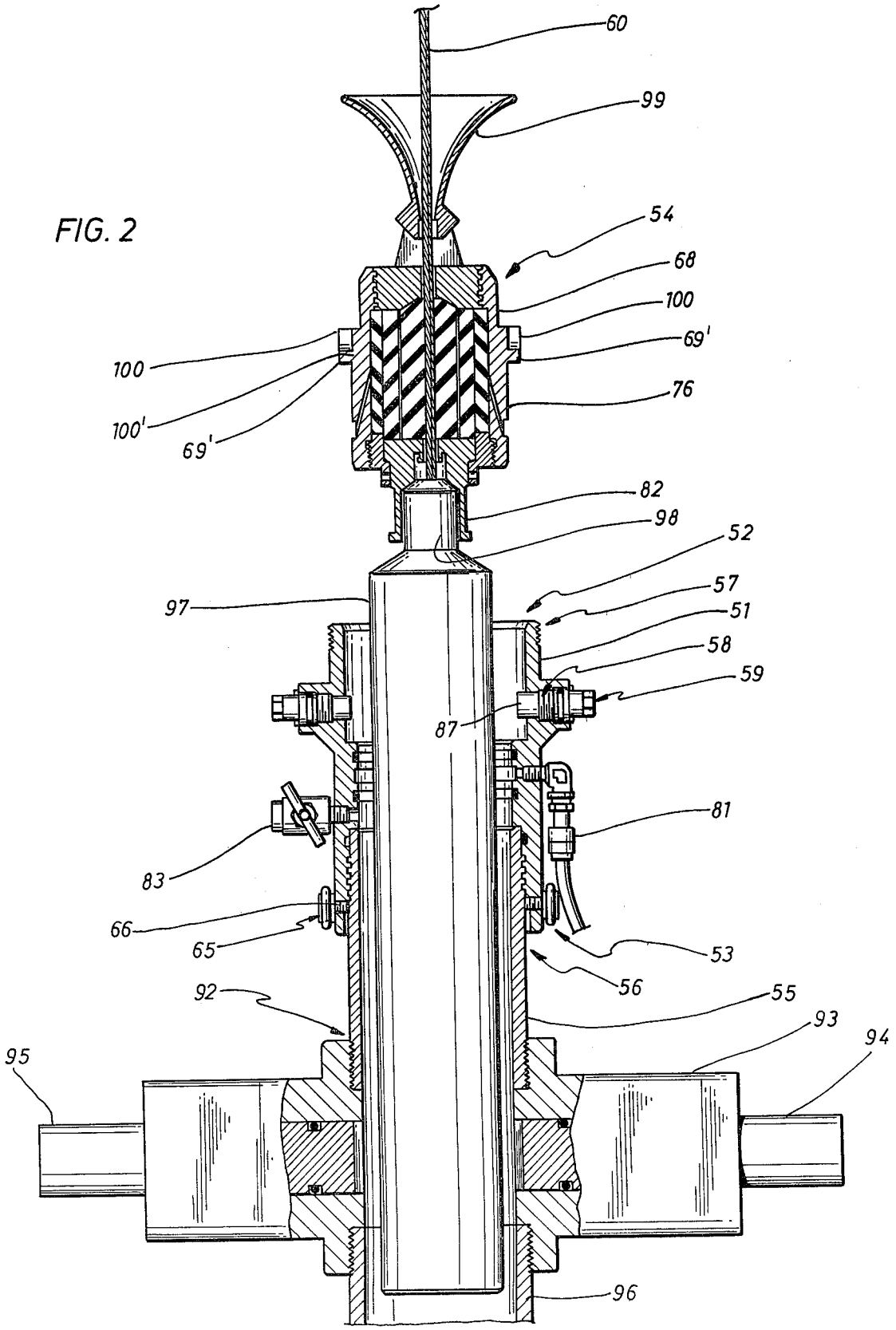
FIG. 2 is a cross-sectional view of the releasable annular wireline blowout preventer of the present invention and illustrates the wireline seal assembly means prior to its being inserted in the annular body.

Referring now to FIGS. 1 and 2, the annular body 51 of releasable annular wireline blowout preventer 50 of the present invention is shown attached to the first riser 55, which is in turn attached, as at 92, to a conventional wellhead cut-off valve 93. As illustrated, riser 55 is threadedly received at 92 into cut-off valve 93; however, first riser 55 could be attached to cut-off valve 93 in any other suitable manner, such as by a flange connection. Cut-off valve 93 is generally shown to include two hydraulically actuated piston members 94 and 95, which may be activated to completely seal the well. For illustration purposes, cut-off valve 93 is threadedly received about conventional well casing 96, as shown in FIG. 2, although other conventional valving equipment could be disposed at the wellhead between valve 93 and casing 96.

As shown in FIG. 2, a conventional wireline tool 97 is shown attached to wireline 60 by a conventional wireline cable head 98. Wireline cable head 98 is received within the guide receptacle 82 disposed at the lower end 71 of wireline seal assembly means 54. As seen in FIG. 2, annular body 51 of releasable annular wireline blowout preventer 50 has an inner diameter capable of allowing the through passage of the conventional wireline suspended tool 97. Accordingly, as shown in FIG. 2, the wireline suspended tool 97 with wireline seal assembly means 54 resting upon cable head 98, may be lowered downwardly through annular body 51, riser 55, and cut-off valve 93 into well casing 96.

Figure 3:
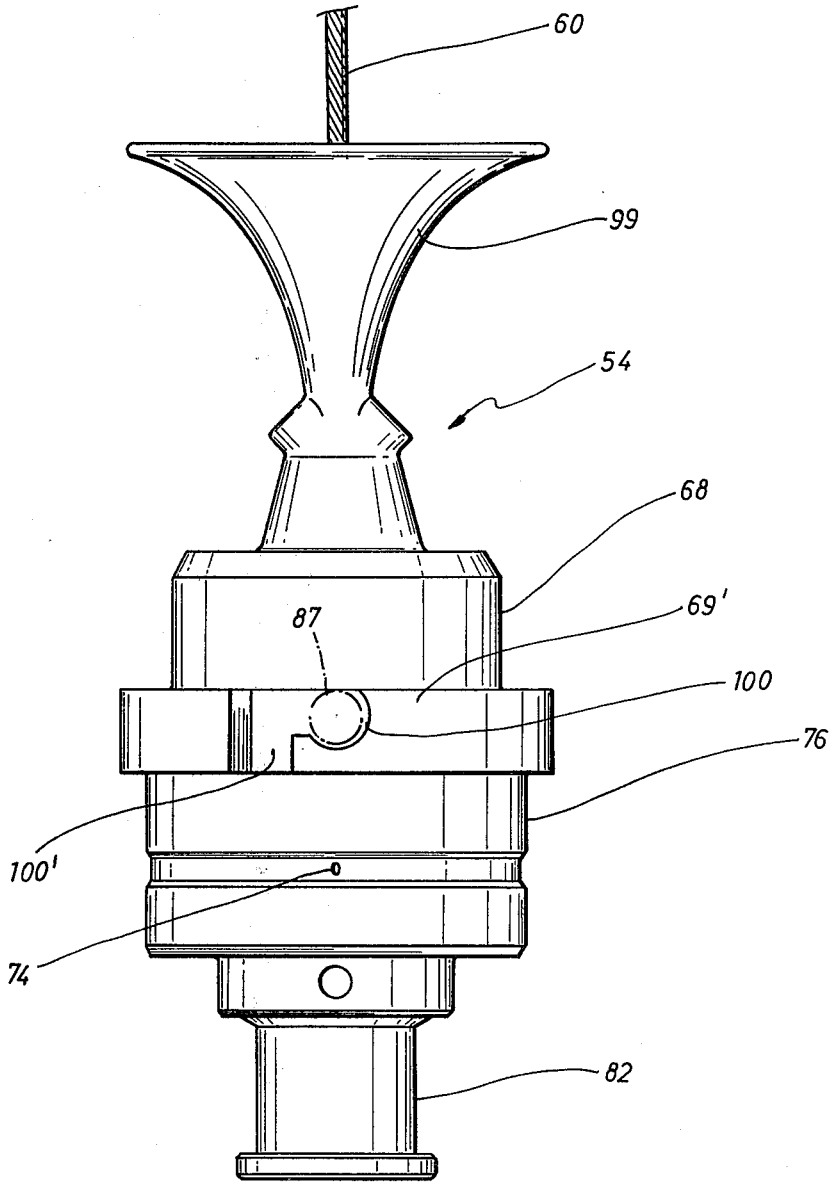
FIG. 3 illustrate details of an alternative means for securing the wireline seal assembly means in the annular body.

As seen in FIGS. 1 and 2, a conventional wireline guide 99 is mounted on the upper portion of wireline seal assembly means 54, and is concentrically mounted about wireline 60. Although the construction of body member 68 of wireline seal assembly means 54 in FIG. 1 discloses the use of an annular rib 69 which is contacted by selective engaging means 58, an alternative construction is shown in FIG. 2. As seen in FIGS. 2 and 3, body member 68 of wireline seal assembly means 54 is provided with at least two slotted portions 100 and 100' formed on the outer surface 76 of annular body member 68. FIG. 3 illustrates wireline sealing assembly means 54 rotated 90 degrees from the position of FIG. 2 to show the construction of slotted portions 100' and 100 in annular rib 69'. Thus, in the embodiment of FIGS. 2 and 3, the outer surface 76 of annular body member 68 of wireline sealing assembly means 54 is provided with a rib 69' with at least one or more pairs of slots 100' and 100 formed in the rib 69'. Slots 100' and 100 are adapted to mate with the end portions 87 of selective engaging means 58 which extend into the interior of annular body 51. Upon the downward movement of sealing assembly means 54 in relation to annular body 51, smooth end portion 87 passes through slotted portion 100'. Upon radial movement of sealing assembly means 54 slot 100 comes to engage smooth end portion 87 thereby preventing upward movement of sealing assembly means 54. Of course, the number of slotted portions 100 and 100' in annular rib 69' will correspond to the number of selective engaging means 58 provided in annular body 51.

Figure 5:
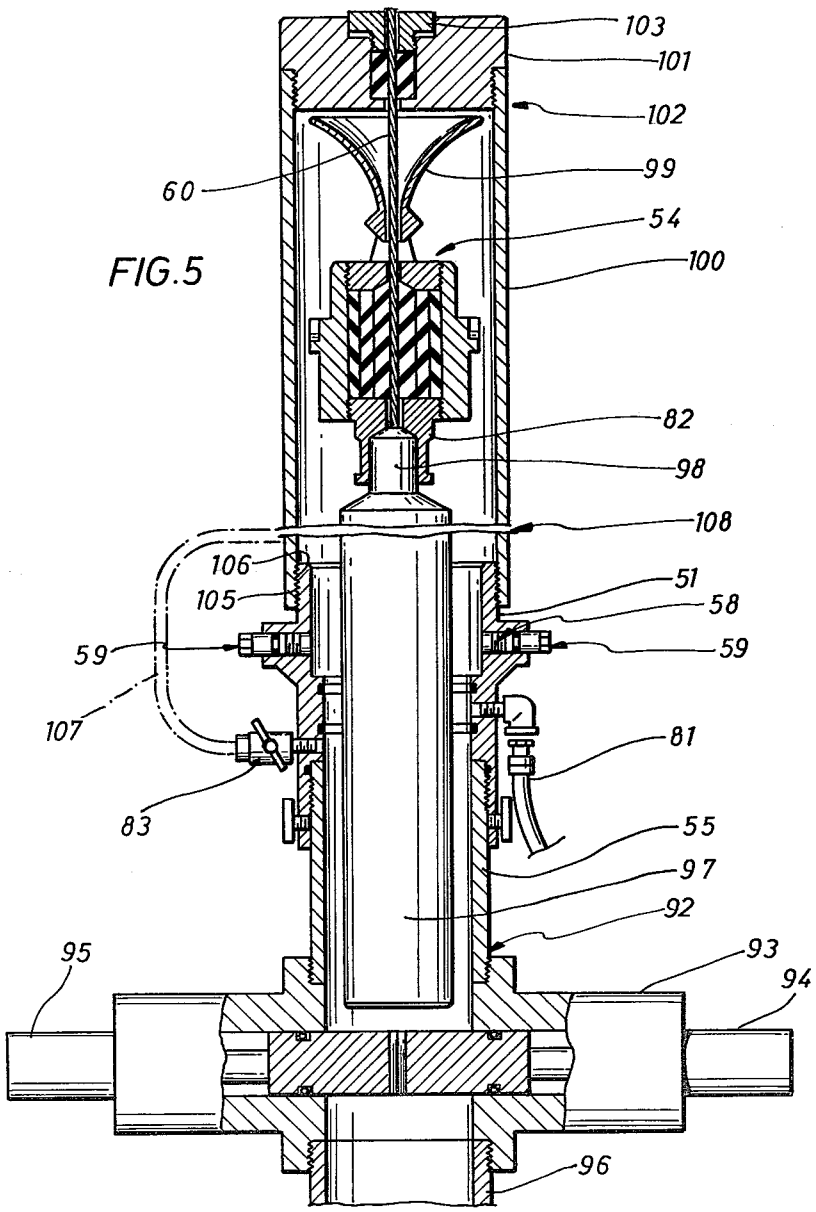
FIG. 5 is a cross-sectional view further illustrating the method of the present invention for conducting wireline operations in oil and gas wells under blowout conditions and, FIG. 6 is an enlarged cross-sectional view of the releasable annular wireline blowout preventer of FIG. 1, wherein another selective engaging means for the wireline seal assembly means is shown.
Figure 4:
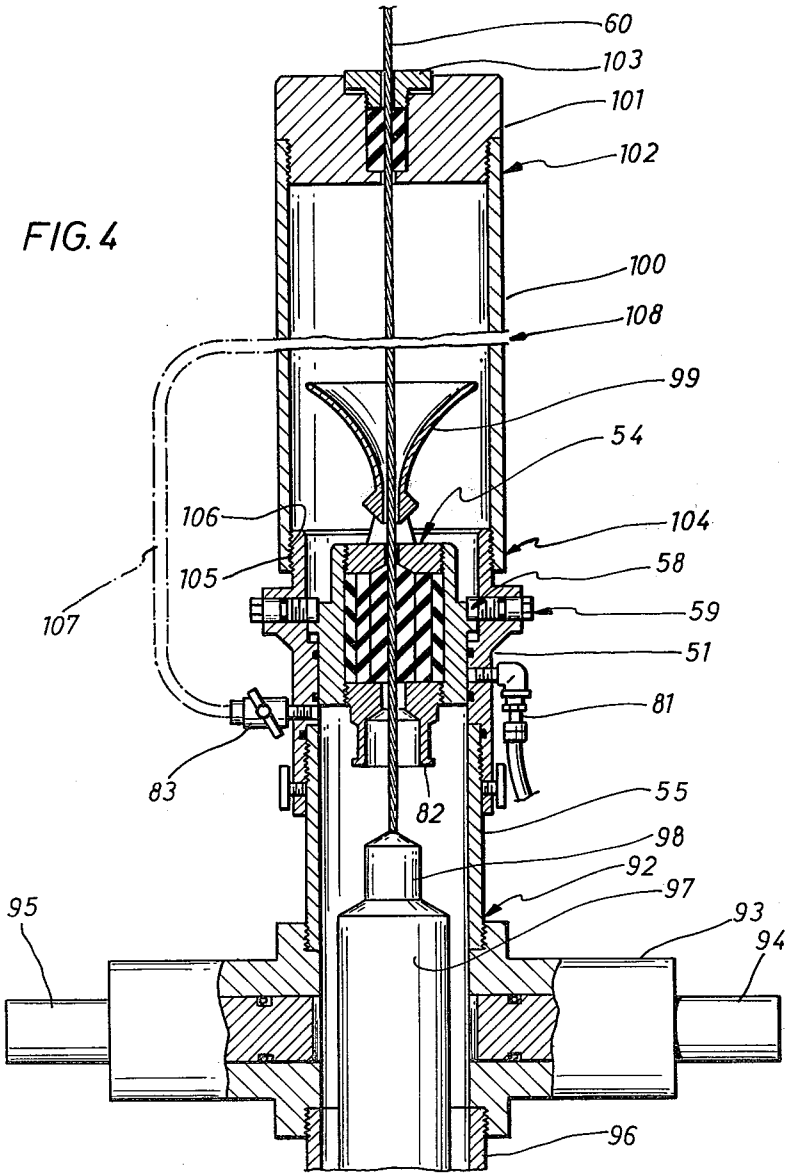
FIG. 4 is a cross-sectional view of the releasable annular wireline blowout preventer, illustrating certain steps of the method of the present invention for conducting wireline operations under blowout conditions.

Turning now to FIGS. 2, 4 and 5 the operation of the releasable annular wireline blowout preventer 50 and the method steps of the present invention will be described. As shown in FIG. 2, a first riser 55 has been attached to cut-off valve 93, and annular body 51 has been attached to first riser 55 by use of the first attachment means 56. At this time hydraulic hose 81 may be connected to annular body 51 at connection 80, and locking means 65, or threaded bolts 66 may be rotated to engage riser 55 to further secure annular member 51 to riser 55. After cut-off valve 93 is opened, wireline suspended tool 97 is lowered through annular body 51, first riser 55, and cut-off valve 93. As seen in FIG. 2, wireline suspended tool 97 has wireline seal assembly means 54 disposed about the wireline 60, as the wireline suspended tool 97 is lowered.

After wireline seal assembly means 54 has been lowered into annular body 51 as depicted in FIG. 1, the wireline seal assembly means 54 is secured within annular body 51 by selective engaging means 58. The end portions 87 of selective engaging means 58 contact the rib portion 69' or 69 of the body member 68 of wireline seal means 54, thus securing the wireline seal assembly means 54 within annular body 51.

Now, normal wireline operations using wireline suspended tool 97 may be conducted by lowering wireline suspended tool 97 into the well casing 96 of the well. As wireline 60 moves downwardly into well casing 96, hydraulic pressure may be applied via hydraulic hose 81 through passageway 74 into groove 75 to slightly compress resilient bladder member 72 and resilient member 73 about and along wireline 60. Accordingly, annular resilient member 73 serves as a wireline wiper for wireline 60.

If blowout conditions are encountered in the well, well casing 96 is immediately sealed by sealing wireline seal assembly means 54 about and along wireline 60 to prevent the leakage of well fluids from the casing 96. This sealing is accomplished by the application of hydraulic pressure from hydraulic hose 81 through passageway 74 into groove 75, whereby bladder member 72 and annular resilient member 73 are strongly compressed against wireline 60, whereby well fluid leakage about and along wireline 60 is prevented.

After blowout conditions have occurred and the well is sealed by the above procedure, it is then necessary to remove the wireline suspended tool 97 from well casing 96. Preferably, the wireline suspended tool 97 is raised by pulling wireline 60 upwardly, so that wireline suspended tool 97 is disposed in a position adjacent cut-off valve 93, as shown in FIG. 4. It should be noted that as wireline 60 is raised, the leakage of well fluids from casing 96 is prevented by the compression of annular resilient member 73 about and along wireline 60 as wireline 60 passes upwardly through annular resilient member 73 of wireline seal assembly means 54.

When the wireline suspended tool 97 is in the approximate position shown in FIG. 4, the wireline 60 may be cut and clamped whereby the portion of the wireline 60 extending outwardly from wireline guide 99 may be easily handled. Of course, that portion of wireline 60 may be suitably clamped in a conventional manner so as to prevent wireline suspended tool 97 from falling downwardly into well casing 96. The portion of wireline 60 extending beyond wireline guide 99 is then passed through a second riser 100. As shown in FIG. 4, second riser 100 has a conventional stuffing box 101 disposed at its upper end 102. After wireline 60 is passed through second riser 100, it is passed through the conventional sealing means 103 of stuffing box 101.

Still referring to FIG. 4, the next step of the method of the invention is to attach the lower end 104 of the second riser 100 to the top of annular body 51. As shown in FIG. 4, the attachment of second riser 100 to annular body 51 is accomplished by engagement of the internal threads 105, formed in the interior lower surface of second riser 100, with the attachment means 57 associated with the upper end 52 of annular body 51. As seen in FIGS. 1 and 4, the second attachment means 57 associated with the annular body 51 comprises external threads 106 formed about the upper outer surface of annular body 51. Of course, it should be readily understood that any other suitable second attachment means 57 could be utilized in lieu of threads 106 on annular body 51 such as by providing a suitable flange connection.

After second riser 100 has been attached to the releasable annular wireline blowout preventer 50 of the present invention, as shown in FIG. 4, stuffing box 101 is actuated whereby stuffing box sealing means 103 is sealed about wireline 60. Then, valve 83 is opened, whereby the pressure difference between first riser 55 and second riser 100 is equalized. As shown in phantom in FIG. 4, a pressure hose 107 may be connected in any suitable manner between valve 83 and second riser 100 to allow the pressure equalization between first and second risers 55 and 100.

With regard to FIGS. 4 and 5, it should be noted that second riser 100 is shown in a break-away view, as at 108, whereby it should be understood that the length of second riser 100 is such that the combined length of the first and second risers is sufficient to enclose the wireline suspended tool.

After the pressure has been equalized between first and second risers 55 and 100, the wireline seal assembly means 54 is released from annular body 51 by operation of the releasing means 59. By rotation of the releasing means 59, or bolt heads 90, the end portions 87 of bolts 85 are moved outwardly from annular body 51 into the position shown in FIGS. 2 and 5, whereby wireline seal assembly means 54 is released from annular body 51.

Turning now to FIG. 5, it is seen that by raising wireline suspended tool 97, wireline cable head 98 will engage the guide receptacle 82 disposed on the lower portion of wireline sealing means 54. As wireline seal assembly means 54 is being raised outwardly from annular body 51 of the releasable annular wireline blowout preventer 50, leakage of well fluids is prevented by the sealing means 103 of stuffing box 101. As seen in FIG. 5 as the wireline suspended tool 97 is being raised, it in turn will raise the wireline seal assembly means 54 to the position shown in FIG. 5. Thus, the wireline suspended tool 97 and wireline seal assembly means 54 are disposed within the second riser 100, and the lower end of the wireline suspended tool 97 will clear and pass the cut-off valve 93. Because the second riser 100 must be long enough to accommodate the combined length of the wireline seal assembly means 54 and the major portion of the length of wireline suspended tool 97, it is readily apparent that the length of second riser 100 may be greater than the length of the first riser 55.

Still referring to FIG. 5, it is seen that after the lower portion of wireline tool 97 clears and passes the cut-off valve 93, the cut-off valve 93 may then be closed to seal the well. Piston members 94 and 95 move inwardly in a conventional manner to seal off the annular space within valve 93. After cut-off valve 93 is closed, the pressure within second riser 100 may be safely released and vented into the atmosphere. After the pressure has been released, the second riser 100, annular body 51, wireline suspended tool 97, and wireline seal assembly means 54 may be readily dismantled from one another until needed once again for conducting wireline operations.

The foregoing description of the invention has been directed in primary part to a particular preferred embodiment in accordance with the requirements of the Patent Statutes and for purposes of explanation and illustration. It will be apparent, however, to those skilled in this art that many modifications and changes in the method and apparatus of the present invention may be made without departing from the scope and spirit of the invention. For example, the annular body of the releasable wireline blowout preventer could be formed integrally with the first short riser, or the outer configuration of that body could be square with an internal annular construction.

It is applicant's intention in the following claims to cover such modifications and variations as fall within the true spirit and scope of the invention.

What is claimed is:

1. A releasable annular wireline blowout preventer for use with oil and gas wells during wireline operations comprising:

an annular body having upper and lower ends and an inner diameter capable of allowing the through passage of a wireline suspended tool;

first means for attaching the annular body to a wellhead cut-off valve, said first attachment means associated with the lower end of the annular body;

second means for attaching the annular body to a length of pressure containing pipe, said second attachment means associated with the upper end of the annular body;

a wireline seal assembly means for preventing well fluid leakage about the wireline, said wireline seal assembly means having an annular rib, said annular body having selective engaging means for securing the seal assembly means within the annular body during normal wireline operations, said selective engaging means having at least one bolt threaded in said annular body, which, upon rotation, extends into the interior of the annular body above said rib on the wireline seal assembly means whereby said wireline seal assembly means is selectively prevented from moving in the upward direction due to well pressures; and means for releasing said selective engaging means to allow the removal of the seal assembly means upwardly through the annular body.

2. The blowout preventer of claim 1 wherein a length of pressure containing pipe is attached by said second attachment means to said annular body, whereby during wireline operations under blowout conditions, the seal assembly means and wireline suspended tool may both be positioned above the well head cut-off valve.

3. The blowout preventer of claim 2 wherein the annular body includes means for equalizing pressure differences from below the wireline seal assembly to the pressure containing pipe.

4. The blowout preventer of claim 1 wherein the wireline seal assembly means includes a hydraulically actuated resilient member which is compressed along and about the wireline upon actuation.

5. The blowout preventer of claim 1, wherein the lower portion of the wireline seal assembly means includes a guide receptacle for the wireline suspended tool.

6. A method for conducting wireline operations in an oil and gas well under the possibility of blowout conditions in the well, said well being provided with a wellhead cut-off valve, comprising the steps of:

(a) fixedly securing an annular body to the cut-off valve, said body having an inner diameter capable of allowing the through passage of a wireline suspended tool; said annular body having means associated with its upper end with means for attaching the annular body to a length of pressure containing pipe;

(b) lowering a wireline suspended tool through said annular body and cut-off valve, said wireline suspended tool having a wireline seal assembly means disposed about the wireline;

(c) securing the wireline seal assembly means within the annular body;

(d) lowering the wireline suspended tool in the well; and (e) readying a length of pressure containing pipe for attachment to said upper end of said annular body in preparation of emergency blowout conditions in the well.

7. The method of claim 6 further comprising the steps of:

(a) sealing the wireline seal assembly means about the wireline upon encountering blowout conditions in the well;

(b) passing a portion of the wireline, which is disposed outside the well and wireline seal assembly means through said length of pressure containing pipe having a stuffing box disposed at its upper end;

(c) attaching the lower end of the pressure containing pipe to the top of the annular body and sealing the stuffing box about the wireline;

(d) equalizing the pressure between the pressure containing pipe and the volume below the bottom of the wireline seal assembly means;

(e) releasing the wireline seal assembly means for the annular body;

(f) raising the wireline suspended tool and wireline seal assembly means into the combined pressure containing pipe and past the cut-off valve; and (g) closing the cut-off valve to seal the well.

8. The method of claim 7 which includes the step of cutting the wireline prior to passing the wireline through the pressure containing pipe.

9. The method of claim 6 which includes the steps of releasing the pressure within the pressure containing pipe after the cut-off valve is closed to seal the well, and dismantling the pressure containing pipe, annular body, wireline suspended tool, and wireline seal assembly means from one another.

10. A method for conducting wireline operations in an oil and gas well and for removal of wireline suspended tools during blowout conditions in the well, said well being provided with a main cut-off valve, comprising the steps of:

(a) fixedly securing an annular body to the top of a first riser associated with the cut-off valve, said body having an inner diameter capable of allowing the through passage of a wireline suspended tool;

(b) opening the cut-off valve;

(c) lowering a wireline suspended tool through said annular body, first riser, and cut-off valve, said wireline suspended tool having a wireline seal assembly means disposed about the wireline;

(d) securing the wireline seal assembly means within the annular body;

(e) lowering the wireline suspended tool into the well;

(f) sealing the wireline seal assembly means about the wireline upon encountering blowout conditions in the well;

(g) passing a portion of the wireline, which is disposed outside the well and wireline seal assembly means through a second riser, having a stuffing box disposed in the upper end of the second riser;

(h) attaching the lower end of the second riser to the top of the annular body and sealing the stuffing box about the wireline;

(i) equalizing the pressure between the first and second risers;

(j) releasing the wireline seal assembly means from the annular body;

(k) raising the wireline suspended tool and wireline seal assembly means into the second riser and past the cut-off valve; and, (l) closing the cut-off valve to seal the well.

11. A releasable annular wireline blowout preventer for use with oil and gas wells during wireline operations comprising:

an annular body having upper and lower ends and an inner diameter capable of allowing the through passage of a wireline suspended tool;

first means for attaching the annular body to a wellhead cut-off valve, said first attachment means associated with the lower end of the annular body;

second means for attaching the annular body to a length of pressure containing pipe, said second attachment means associated with the upper end of the annular body;

a wireline seal assembly means for preventing well fluid leakage about the wireline, said annular body having selective engaging means for securing the seal assembly means within the annular body during normal wireline operations, said selective engaging means having one or more slotted portions on the outer annular surface of the wireline assembly means, said slotted portions selectively adapted to mate with corresponding end portions of one or more bolts in said annular body extending into the interior of said annular body by downward and radial movement of the sealing assembly means with respect to the annular body; and means for releasing said selective engaging means to allow the removal of the seal assembly means upwardly through the annular body.

12. A releasable annular wireline blowout preventer for use with oil and gas wells during wireline operations comprising:

an annular body having upper and lower ends and an inner diameter capable of allowing the through passage of a wireline suspended tool;

first means for attaching the annular body to a wellhead cut-off valve, said first attachment means associated with the lower end of the annular body;

second means for attaching the annular body to a length of pressure containing pipe, said second attachment means associated with the upper end of the annular body;

a wireline seal assembly means for preventing well fluid leakage about the wireline, said wireline seal assembly having an annular rib, said annular body having selective engaging means for securing the seal assembly means within the annular body during normal wireline operations, said selective engaging means having one or more hydraulically operated piston members having end portions extending into the interior of the annular body above said rib on the wireline seal assembly means whereby said wireline seal assembly means is selectively prevented from moving in the upward direction due to well pressures; and means for releasing said selective engaging means to allow the removal of the seal assembly means upwardly through the annular body.

* * * * *